US005314128A

United States Patent [19]

Alexander, III

[11] Patent Number: 5,314,128

[45] Date of Patent: May 24, 1994

[54] CLOTH MEASURING APPARATUS AND METHOD

[75] Inventor: William J. Alexander, III, Mauldin, S.C.

[73] Assignee: Alexander Machinery, Inc., Mauldin, S.C.

[21] Appl. No.: 535,327

[22] Filed: Jun. 8, 1990

[51] Int. Cl.[5] ..... B65H 18/20; B65H 63/08

[52] U.S. Cl. ..... 242/57; 242/66; 33/737; 33/754

[58] Field of Search ..... 242/57, 66; 33/734–749, 754; 139/304, 307, 308, 311

[56] References Cited

U.S. PATENT DOCUMENTS

| | | | |
|---|---|---|---|
| 597,836 | 1/1898 | Carpenter | 33/746 |
| 1,095,160 | 4/1914 | Kessler | 33/737 |
| 3,838,519 | 10/1974 | Chick | 33/747 |
| 3,916,174 | 10/1975 | Moule | 33/735 X |
| 4,216,804 | 8/1980 | Alexander et al. | 139/311 |
| 4,285,130 | 8/1981 | Chandler | 33/741 |
| 4,535,949 | 8/1985 | Olsson | 242/66 |
| 4,535,950 | 8/1985 | Lisnyansky | 242/66 |

*Primary Examiner*—John M. Jillions
*Attorney, Agent, or Firm*—Ralph Bailey

[57] ABSTRACT

An apparatus and method for measuring the length of cloth moving in open width from a loom to a cloth winder is illustrated wherein a wheel C is positioned in tangential relation upon cloth moving over a direction roll reflecting the length of the cloth in response to rotations of the wheel.

4 Claims, 3 Drawing Sheets

Fig. 3-A.

CLOTH MEASURING APPARATUS AND METHOD

BACKGROUND OF THE INVENTION

This invention relates to measuring the length of cloth manufactured or processed utilizing a wheel driven by the cloth as it passes over a roll to generate a signal. It is difficult to accurately measure the length of cloth moving in open width because of varying tension in the cloth and because finding a location for properly sensing the cloth passing to a takeup roll for reflecting the length has proved to be a problem. Pick counters are often employed to determine the length of cloth manufactured on a loom because if the number of picks per inch of the cloth construction is known, it is believed possible to count the total number of picks woven by the loom to determine length of cloth. Inaccuracies result, however, because of the number of picks per unit of lengths is seldom if ever precisely known, and any inaccuracy becomes multiplied as many yards of cloth are woven.

Accordingly, it is an important object of this invention to provide an accurate device for sensing the cloth woven on a loom and taken up on a takeup roll to measure its length.

Another important object of the invention is to utilize a desirable sensing location and then accurately sense and measure the cloth taken up.

Still another important object of the invention is to utilize the direction roll just prior to take up to measure the cloth passing thereover and tangential thereto to accurately reflect the length of cloth.

Another object of the invention is to control tension in the cloth during measurement utilizing rotations of a measuring wheel to measure yardage of the cloth taken up.

SUMMARY OF THE INVENTION

It has been found that the most accurate location to sense cloth for length measurement is just prior to take up on the takeup roll. By utilizing a point of tangency with the direction roll just prior to take up and the point of tangency with the cloth passing thereover, a more nearly accurate measurement may be achieved as the effects of variations in cloth tension are minimized. Sensitive and accurate measurements may be achieved utilizing a pivoted arm carried by a mounting adjacent the cloth take up for carrying a wheel biased by gravity against the cloth preferably at or near the point of tangency. A signal generator driven by the wheel is utilized to signal a suitable recording and totalizing device such as a yardage counter or the loom monitoring system which may be located remotely from the sensor.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3A is a view of an alternative recording device in the form of a loom monitor system.

DESCRIPTION OF A PREFERRED EMBODIMENT

Referring more particularly to the drawings, apparatus is illustrated for measuring the length of cloth moving in open width over a direction roll to a cloth winder. A support bracket A mounts measuring apparatus adjacent the cloth winder. An arm B is pivotally mounted upon the support bracket adjacent one end thereof so that the other free end is biased downwardly by gravity. A wheel C is carried by the arm adjacent the free end and is rotated responsive to engagement of a periphery thereof with said cloth passing over the direction roll in substantially tangential relation thereto. A pulse generator D or other measuring device is carried by the arm adjacent the wheel and is actuated responsive to a rotation thereof. The length of cloth is preferably moved from a loom, under a platform to a surface winder having the direction roll over which the cloth passes immediately prior to its passage to the takeup roll.

A recording device E is provided for receiving signals from the pulse generator reflecting length in terms of the number of rotations of the wheel C. The method of measuring cloth manufactured upon a loom and being wound upon a surface winder contemplates moving the cloth over a direction roll prior to its passage to the takeup roll. By pivotally mounting an arm adjacent one end, a measuring device having an actuating wheel may be positioned on the free end of the arm opposite the pivotal mounting. By mounting the wheel normal to the cloth moving over the direction roll substantially tangentially to the roll, the actuating wheel is rotated by the cloth accurately reflecting the length of the cloth.

Figure 1:
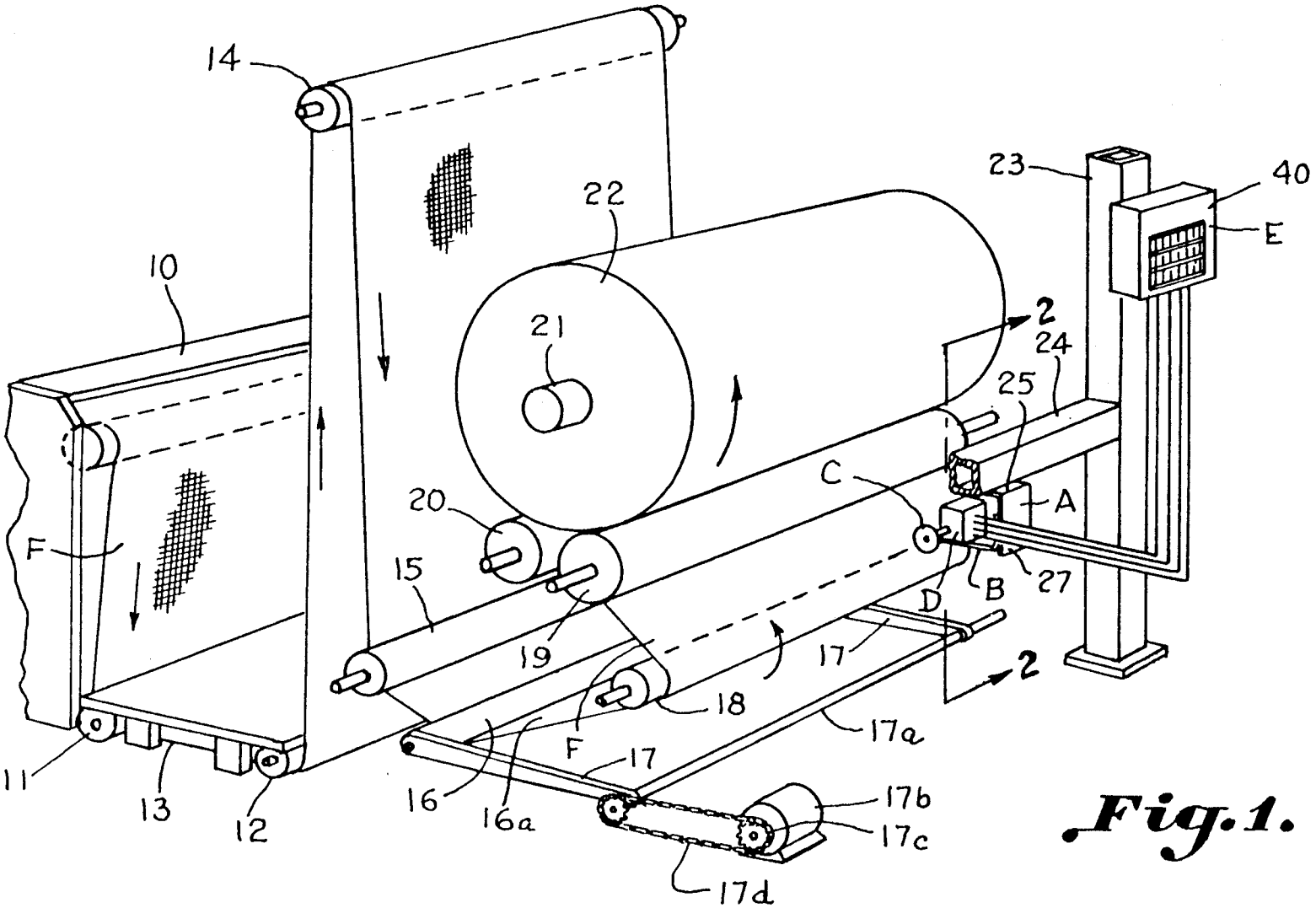
FIG. 1 is a perspective view schematically illustrating cloth woven on a loom passing beneath a platform, over an inspection device, over a tension compensator and on to a measuring device constructed in accordance with the invention located just prior to take up.

FIG. 1 schematically illustrates a loom 10 which manufacturers a length of cloth F which passes beneath the fixed rolls 11 and 12 carried beneath an operators' platform 13 as illustrated in Pat. No. 4,407,332, the disclosure of which is incorporated herein by reference. The cloth F then moves upwardly over a roll 14 of an inspector device and thence downwardly beneath a direction roll 15 prior to passing beneath the compensator roll 16 of a tension compensating device mounted for oscillation upon the arms 17 as described in Pat. No. 4,216,804, the disclosure of which is incorporated herein by reference. The speed of the driven rolls 19 and 20 is controlled by the oscillations of the compensator roll 16 up and down responsive to variations in tension in the cloth through the shaft 17*a* which controls a drive motor 17*b* for the rolls 19 and 20. The shaft 17*a* controls the speed of the motor as by operating a rheostat 17*c* of the motor through a timing belt 17*d*.

After leaving the compensator roll 16, the cloth passes in a substantially horizontal run 16*a* and thence over a direction roll 18 just prior to passing to the surface winder which includes driven support rolls 19 and 20 before being wound upon the core 21 of the takeup roll 22. The support rolls 19 and 20 are driven in the usual manner, and the cloth is illustrated as passing over the roll 19 to the takeup roll 22. The takeup is illustrated as including a frame having a vertical support member 23 and a horizontal transverse member 24 adjacent the direction roll 18 immediately prior to takeup.

Figure 2:
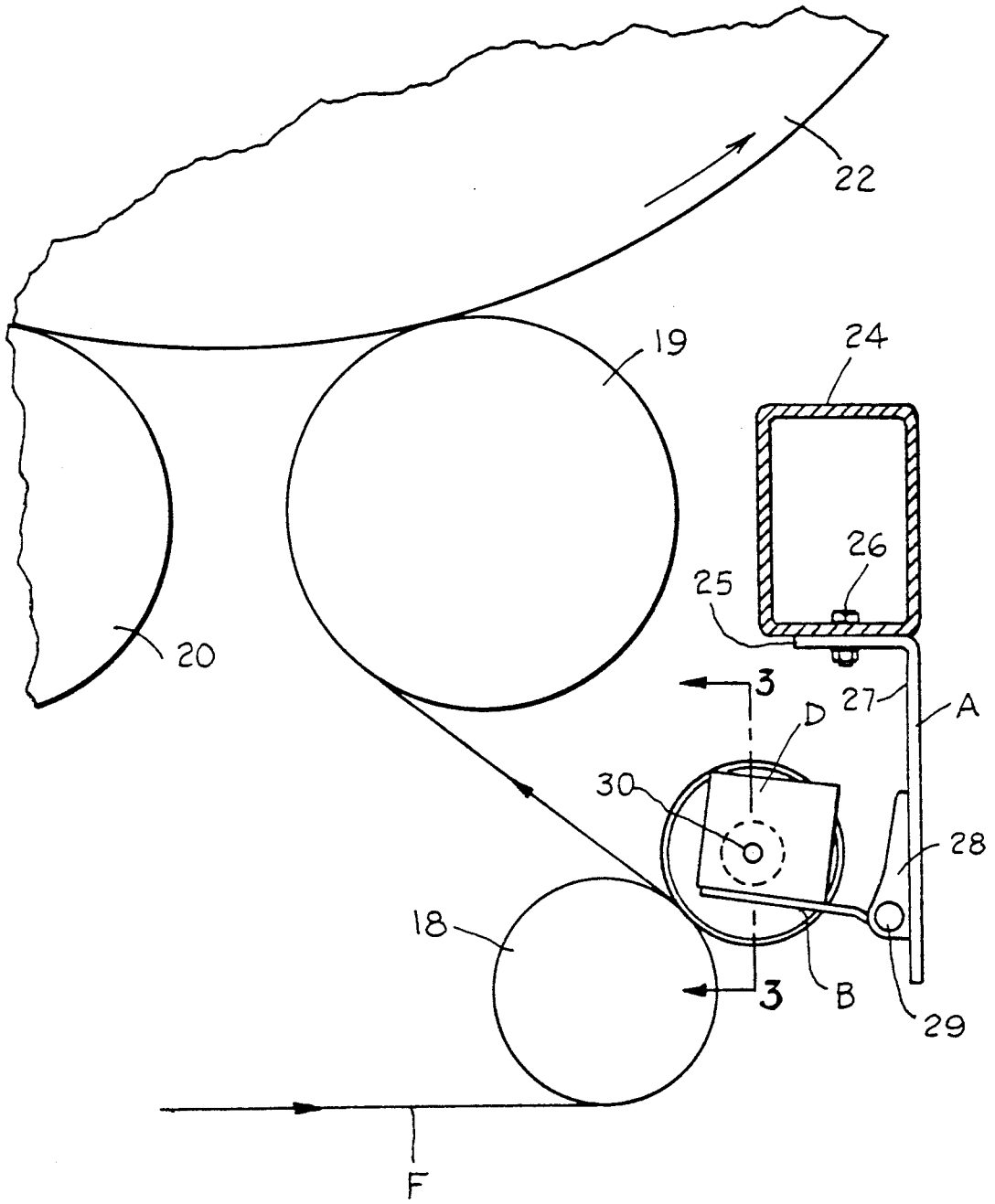
FIG. 2 is an enlarged longitudinal sectional elevation taken on the line 2—2 in FIG. 1.
Figure 3:
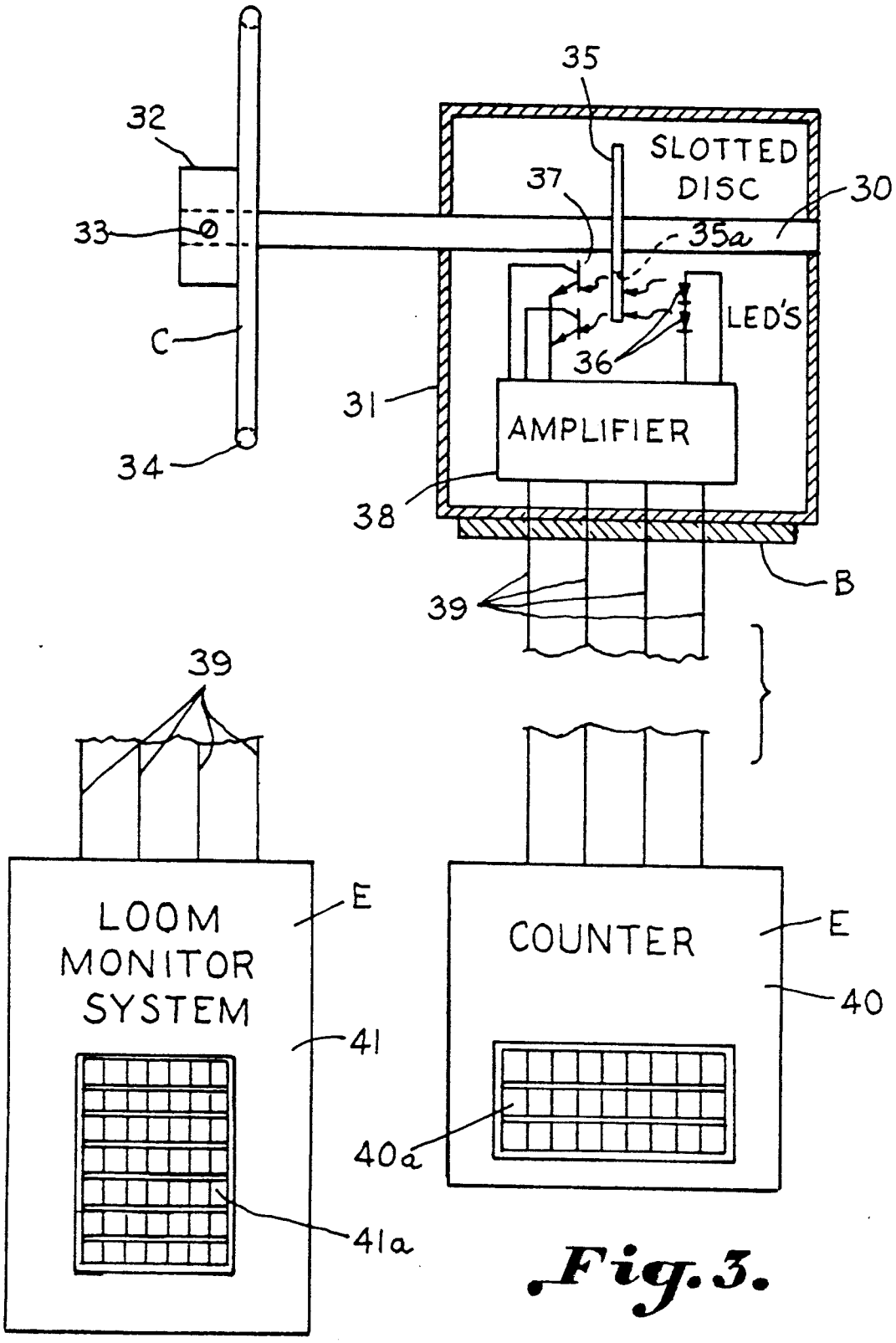
FIG. 3 is an enlarged sectional elevation taken on the line 3—3 in FIG. 2 illustrating the wheel and pulse generator operated in response to rotation of the wheel.

The bracket A is illustrated in FIGS. 1 and 2 and includes a horizontal flange 25 as secured by suitable threaded fasteners 26 on the bottom of the transverse means 24. The support bracket A includes a vertical web member 27. A fixture 28 for pivotally carrying one end of the arm B is positioned on a lower end of the web member 27 of the support bracket A. The fixture carries a pivot member 29 for carrying one end of the arm B so that the free end may carry a pulse generator D. The free end of the arm B is biased toward the cloth preferably at the point of tangency with the direction roll 18, preferably by gravity as shown but such bias may be exerted upwardly or otherwise as by a spring. A pulse generator D positions a wheel upon a free end of the arm B upon a shaft 30 which extends outwardly of a housing 31 of the pulse generator D The shaft 30 carries the hub 32 and the wheel C which is secured to the shaft as by a set screw 33. The wheel may include a suitable friction member such as a rubber ring 34 or other means such as for example a knurled wheel.

The pulse generator D includes a disk 35 carried by the shaft 30. The disk 35 has a slot 36 therein through which passes light from the usual light emitting diodes 36 which is received by the photo transistor sensors 37. The signal generated by the pulse generator then passes through the amplifier 38 and the lines 39 to a recording mechanism E and may consist of a counter 40 secured to the upright frame member 23 which provides a read out as at 40*a*. Alternatively, the signal from amplifier 38 may pass to a recorder in the form of a loom monitor system 41 which has a read out 41*a*.

It is thus seen that a yardage counter for cloth has been provided which accurately measures the actual length through the use of a rotatable measuring wheel positioned at a point of tangency with the cloth passing over a direction roll just prior to takeup. It is at the point closest to takeup that the cloth possesses more nearly uniform tension so that more accurate measurements may be taken at this point. Because of the pivotal mounting of the wheel which is biased preferably by gravity against a point of tangency of the cloth with the direction roll, very accurate sensing of the cloth may be accomplished by the rotation wheel. Through the use of the pulse generator, accurate information concerning the revolution of the measurement wheel may be transmitted to the monitoring device such as a counter or a loom monitoring system which preferably passes suitable provision for read out.

While a preferred embodiment of the invention has been described using specific terms, such description is for illustrative purposes only, and it is to be understood that changes and variations may be made without departing from the spirit or scope of the following claims.

What is claimed is:

1. Apparatus for measuring the length of cloth moving from a loom in open width under a platform to a surface winder including a direction roll over which said cloth passes immediately prior to passing to a takeup roll comprising:

a support bracket;

an arm pivotally mounted upon said support bracket adjacent one end thereof so that another free end thereof is biased downwardly by gravity toward said cloth passing over said direction roll;

a wheel carried by said arm adjacent said free end rotated by engagement with said cloth passing over said direction roll in substantially tangential relation thereto;

a pulse generator carried by the arm adjacent the wheel actuated responsive to rotation thereof; and a recording device receiving signals from said pulse generator.

2. The method of measuring cloth manufactured upon a loom and being wound upon a takeup roll comprising the steps of:

moving said cloth over a direction roll prior to its passage to said takeup roll;

pivotally mounting an arm adjacent one end;

positioning an actuating wheel upon a free end of said arm opposite said pivotal mounting;

mounting said wheel normal to said cloth moving over said direction roll substantially tangentially to said roll;

biasing said arm downwardly by gravity;

actuating a pulse generator responsive to rotations of said wheel; and actuating a recording device responsive to said pulse generator;

whereby said actuating wheel is rotated by said cloth accurately reflecting the length of the cloth.

3. In combination with a loom tension control apparatus for use in a surface winder having a pair of driven spaced rolls carrying a takeup roll therebetween positioned in front of a machine from which cloth is delivered in open width to the takeup roll for winding thereon, apparatus for measuring the length of cloth wound on said takeup roll, comprising:

means conveying said cloth in at least one substantially horizontal run during its delivery to the takeup roll;

a movable roll supported by said cloth in said horizontal run, said roll being oscillated up and down responsive to variations in tension in said cloth controlling the speed of said spaced rolls and hence the tension on the cloth moving in open width;

a support bracket;

an arm pivotally mounted upon said support bracket adjacent one end thereof so that another free end thereof is biased toward said cloth;

a wheel carried by said arm adjacent said free end rotated by engagement with said cloth moving in open width in substantially vertical relation thereto, an exterior surface of said wheel being provided with a friction member to enhance contact with said cloth;

a substantially horizontal run of cloth between said movable roll and a direction roll guiding cloth to said takeup roll, said wheel being in substantially tangential relation to said direction roll; and a measuring device carried by the arm adjacent the wheel actuated responsive to rotation thereof.

4. In combination with a surface winder having a pair of driven spaced rolls carrying a takeup roll therebetween positioned in front of a machine from which cloth is delivered in open width to the takeup roll for winding thereon, apparatus for measuring the length of cloth wound on said takeup roll, comprising:

a direction roll over which said cloth passes prior to being wound on said takeup roll;

a support bracket;

an arm pivotally mounted upon said support bracket adjacent one end thereof so that the other free end thereof is biased toward said cloth passing over said direction roll;

a wheel carried by said arm adjacent said free end rotated by engagement with said cloth passing over said direction roll in substantially tangential relation thereto, an exterior surface of said wheel being provided with a friction member to enhance contact with said cloth;

a pulse generator carried by the arm adjacent the wheel actuated responsive to rotation thereof; and a recording device receiving signals from said pulse generator.

* * * * *